US009499986B2

(12) United States Patent
Kalkanoglu et al.

(10) Patent No.: US 9,499,986 B2
(45) Date of Patent: Nov. 22, 2016

(54) SYSTEM, METHOD AND APPARATUS FOR THERMAL ENERGY MANAGEMENT IN A ROOF

(71) Applicant: CertainTeed Corporation, Malvern, PA (US)

(72) Inventors: Husnu M. Kalkanoglu, Swarthmore, PA (US);
(Continued)

(73) Assignee: CERTAINTEED CORPORATION, Malvern, PA (US)

( * ) Notice: Subject to any disclaimer, the term of this patent is extended or adjusted under 35 U.S.C. 154(b) by 0 days.

(21) Appl. No.: 14/492,672

(22) Filed: Sep. 22, 2014

(65) Prior Publication Data

US 2015/0082722 A1 Mar. 26, 2015

Related U.S. Application Data

(60) Provisional application No. 61/881,731, filed on Sep. 24, 2013.

(51) Int. Cl.
*E04C 1/00* (2006.01)
*E04D 1/30* (2006.01)
(Continued)

(52) U.S. Cl.
CPC ..... *E04D 1/30* (2013.01); *E04D 13/12* (2013.01); *E04D 13/172* (2013.01); *E04D 5/12* (2013.01);
(Continued)

(58) Field of Classification Search
CPC ..... E04D 11/02; E04D 12/002; E04D 13/17; E04D 13/172; E04D 5/10;
(Continued)

(56) References Cited

U.S. PATENT DOCUMENTS 3,016,317 A 1/1962 Brunner
3,319,392 A * 5/1967 Fitzgerald ..... E04F 13/0862 428/49
(Continued)

FOREIGN PATENT DOCUMENTS

| | | | |
|---|---|---|---|
| CN | 101922209 | A | 12/2010 |
| WO | 2011/045574 | A1 | 4/2011 |
| WO | 2012033816 | A1 | 3/2012 |
| WO | 2013096171 | A1 | 6/2013 |

OTHER PUBLICATIONS

Jan Kosny, PhD et al. "Theoretical and Experimental Thermal Performance Analysis of Building Shell Components Containing Blown Fiberglass Insulation Enhanced with Phase-Change Material (PCM)" (13 pages).
(Continued)

*Primary Examiner* — Brian Glessner
*Assistant Examiner* — Joshua Ihezie
(74) *Attorney, Agent, or Firm* — Abel Law Group, LLP; Alexander H. Plache

(57) ABSTRACT

A building product may include a top layer that is substantially rigid such that it is configured to be walkable. In addition, the building product may include a radiant barrier layer configured to reflect heat, and a vent layer located between the top layer and a roof deck. The vent layer may comprise air flow channels configured to transfer heat through at least a portion of the roof product. The top layer, vent layer and radiant barrier layer can form a unitary structure.

7 Claims, 9 Drawing Sheets

(72) Inventors: Ming Liang Shiao, Collegeville, PA (US); Gregory F. Jacobs, Oreland, PA (US); Rajesh Ranjan, Princeton, NJ (US)

(51) Int. Cl.
*E04D 13/12* (2006.01)
*E04D 13/17* (2006.01)
*E04D 5/12* (2006.01)

(52) U.S. Cl.
CPC .... *E04D 2001/309* (2013.01); *Y10T 29/49623* (2015.01); *Y10T 428/239* (2015.01); *Y10T 428/24281* (2015.01)

(58) Field of Classification Search
CPC ..... E04D 13/1643; E04D 1/28; E04D 3/35; E04D 2001/309; E04D 1/30; E04D 13/00; B32B 2419/06; B32B 3/30; E04B 2001/7691; E04C 2/32; Y10T 428/239; Y10T 29/49623; Y10T 428/24281
USPC ..... 52/309.1, 232, 408; 428/172
See application file for complete search history.

(56) References Cited

U.S. PATENT DOCUMENTS 3,445,322 A * 5/1969 Saiia et al. ..... 428/178
3,561,177 A * 2/1971 Agro et al. ..... 52/169.14
3,598,688 A * 8/1971 Bellamy ..... 428/67
3,958,385 A * 5/1976 Bondra et al. ..... 52/404.1
4,023,321 A 5/1977 Smith
4,163,445 A 8/1979 Stanger
4,189,886 A * 2/1980 Frohlich et al. ..... 52/302.1
4,218,502 A 8/1980 Graham et al.
4,234,639 A 11/1980 Graham
4,244,353 A 1/1981 Straza
4,310,587 A * 1/1982 Beaupre ..... 442/31
4,315,392 A * 2/1982 Sylvest ..... 52/309.1
4,326,631 A * 4/1982 Annand ..... 206/389
4,329,827 A 5/1982 Thorn
4,351,873 A 9/1982 Davis
4,428,360 A 1/1984 Cohen
4,726,985 A * 2/1988 Fay et al. ..... 428/138
4,804,578 A * 2/1989 Crookston ..... 428/304.4
4,848,057 A 7/1989 MacDonald
4,931,340 A 6/1990 Baba et al.
4,937,990 A 7/1990 Paquette
4,943,185 A * 7/1990 McGuckin et al. ..... 405/45
5,067,298 A * 11/1991 Petersen ..... 52/742.14
5,069,950 A * 12/1991 Crookston, Sr. ..... 428/156
5,088,249 A * 2/1992 Marzouki ..... 52/232
5,100,725 A * 3/1992 Pearson ..... 428/314.4
5,231,814 A * 8/1993 Hageman ..... 52/408
5,369,926 A * 12/1994 Borland ..... 52/302.1
5,373,674 A 12/1994 Winter, IV
5,383,314 A * 1/1995 Rothberg ..... 52/169.5
5,473,847 A 12/1995 Crookston
5,524,381 A * 6/1996 Chahroudi ..... 47/17
5,626,936 A 5/1997 Alderman
5,635,306 A 6/1997 Minamida et al.
5,644,880 A * 7/1997 Lehnert et al. ..... 52/408
5,651,226 A 7/1997 Archibald
5,770,295 A 6/1998 Alderman
6,006,481 A * 12/1999 Jacobs ..... 52/309.9
6,017,597 A * 1/2000 Minakami et al. ..... 428/34.4
6,061,978 A 5/2000 Dinwoodie et al.
6,308,482 B1 * 10/2001 Strait ..... 52/408
6,645,598 B2 11/2003 Alderman
6,672,024 B2 1/2004 Alderman
6,691,472 B2 2/2004 Hubert
6,694,693 B2 2/2004 Alderman
6,769,223 B2 8/2004 Alderman
6,802,159 B1 * 10/2004 Kotler ..... E01C 5/20 404/35
6,804,922 B1 * 10/2004 Egan ..... 52/408
6,877,288 B2 4/2005 Shirota
6,955,018 B2 10/2005 Alderman
7,146,771 B2 12/2006 Swann
7,191,845 B2 3/2007 Loar
7,540,118 B2 6/2009 Jensen
7,585,556 B2 * 9/2009 Julton ..... 428/156
7,604,536 B2 10/2009 Coulton et al.
7,618,310 B2 11/2009 Daniels
7,641,812 B2 1/2010 Alderman
7,698,858 B2 4/2010 Schoer et al.
7,703,254 B2 4/2010 Alderman
7,704,584 B2 4/2010 Alderman
7,735,267 B1 6/2010 Ayers, Jr.
7,743,573 B1 * 6/2010 Doberstein et al. ..... 52/518
7,814,703 B2 10/2010 Irwin
7,877,955 B2 2/2011 Kelly
7,877,957 B2 2/2011 Vandewater, Jr.
8,178,449 B2 5/2012 La Vietes et al.
8,216,681 B2 7/2012 Mellott, II et al.
8,277,882 B2 10/2012 Smith et al.
8,291,660 B2 10/2012 McCary
8,309,200 B2 * 11/2012 Zupon et al. ..... 428/121
8,497,010 B2 7/2013 Bletsos et al.
8,522,509 B2 * 9/2013 Tracy et al. ..... 52/746.1
8,707,643 B1 4/2014 Kalkanoglu et al.
8,782,967 B2 7/2014 Daniels
8,973,310 B1 3/2015 Henderson
2003/0061776 A1 4/2003 Alderman
2003/0129330 A1 7/2003 Alderman
2003/0167718 A1 9/2003 Alderman
2003/0167730 A1 9/2003 Alderman
2003/0167731 A1 9/2003 Alderman
2003/0167732 A1 9/2003 Alderman
2003/0230040 A1 * 12/2003 Shirota ..... 52/302.1
2004/0010983 A1 * 1/2004 Eshpar ..... 52/71
2004/0013854 A1 1/2004 Zanchetta et al.
2004/0148887 A1 8/2004 Di Pede
2005/0063780 A1 * 3/2005 Thorne ..... 404/41
2005/0139126 A1 6/2005 Khan et al.
2006/0040091 A1 * 2/2006 Bletsos et al. ..... 428/137
2006/0096189 A1 5/2006 Pavlansky et al.
2006/0099361 A1 * 5/2006 Jablonka et al. ..... 428/35.2
2006/0266405 A1 11/2006 Lenox
2006/0272281 A1 12/2006 Marshall
2007/0107304 A1 * 5/2007 Fan ..... 47/65.5
2007/0130850 A1 6/2007 Miekka
2008/0152867 A1 * 6/2008 Di Pede ..... 428/141
2008/0220714 A1 9/2008 Caruso et al.
2008/0236058 A1 10/2008 Antonie
2008/0248257 A1 10/2008 Zanchetta et al.
2008/0282637 A1 11/2008 Alderman
2008/0312359 A1 12/2008 Alderman
2009/0011171 A1 1/2009 Alderman
2009/0107073 A1 * 4/2009 Kalkanoglu et al. ..... 52/411
2010/0037548 A1 2/2010 Kalkanolgu et al.
2010/0126663 A1 5/2010 Kalkanoglu et al.
2010/0132275 A1 6/2010 Stanger
2011/0000152 A1 1/2011 Botke
2011/0000153 A1 1/2011 Albert
2011/0027536 A1 * 2/2011 Malpass et al. ..... 428/172
2011/0173910 A1 7/2011 Franklin et al.
2011/0209426 A1 * 9/2011 Pollack ..... 52/302.1
2011/0252723 A1 * 10/2011 Devery ..... 52/173.3
2012/0047839 A1 * 3/2012 Walker ..... 52/580
2012/0266553 A1 * 10/2012 Shiao et al. ..... 52/232
2012/0285116 A1 11/2012 Walker
2012/0288674 A1 11/2012 Botke
2013/0000237 A1 1/2013 Kraus
2013/0000811 A1 1/2013 Engeldinger et al.
2013/0008113 A1 1/2013 Kraus
2013/0091793 A1 * 4/2013 Pollack ..... 52/302.1
2013/0133258 A1 * 5/2013 Carter ..... 47/59 S
2013/0247490 A1 * 9/2013 Strait ..... 52/302.1

(56) References Cited

U.S. PATENT DOCUMENTS

2013/0263530 A1* 10/2013 Shiao et al. ..... 52/95
2014/0318038 A1 10/2014 Daniels

OTHER PUBLICATIONS

William Miller, PhD et al. "Natural Convection Heat Transfer in Roofs with Above-Sheathing Ventilation" (14 pages).
Oak Ridge National Laboratory "Ventilation and Solar Heat Storage System Offers Big Energy Savings" (1 page).
Journal of Building Enclosure Design "Winter 2011" ( 5 pages).
Jan Kośny et al. "Sustainable Retrofit of Residential Roofs Using Metal Roofing Panels, Thin-Film Photovoltaic Laminates, and PCM Heat Sink Technology" ( 4 pages).
William (Bill) Miller, PhD. et al. "TASK 2.5.7 Field Experiments to Evaluate Coolcolored Roofing" (33 pages).
William Miller et al.; 2008 ACEEE Summer Study on Energy Efficiency in Buildings "Next-Generation Roofs and Attics for Homes" (16 pages).
Colbond "Thermal Benefits of Roof Underlayments", 4 pgs, 2009.
Invinsa "High Density Polyiso Advantage", 2 pages, accessed 2013.
Pactiv Corporation "GREENGUARD® Roofing Recovery Board PB6", 2 pgs, 2010.
Pactiv LLC "GREENGUARD® Roofing Recovery Board PB6FA",2 pgs, 2013.
ELMICH "VersiDrain® 8 Geo", 2 pgs, accessed 2013.
JDR Enterprises, Inc. "Foundation Wall Drainage Systems", 2 pgs, accessed 2014.
CertainTeed "Platon Air Gap Waterproofing Membrane", 4 pgs, Jul. 2011.
Delta-Drain, "Systems for Building Healthier Homes", 4 pgs.

* cited by examiner

SYSTEM, METHOD AND APPARATUS FOR THERMAL ENERGY MANAGEMENT IN A ROOF

This application claims priority to and the benefit of U.S. Provisional Application No. 61/881,731, filed Sep. 24, 2013, which is incorporated herein by reference in its entirety.

BACKGROUND OF THE INVENTION

1. Field of the Disclosure

The present invention relates in general to roofing and, in particular, to a system, method and apparatus for thermal energy management in a roof.

2. Description of the Related Art

Typical residential roofs in the North America have bitumen-based roofing materials that provide satisfactory water shedding, long term durability and have aesthetic appeal. Most asphaltic roofing materials are colored in traditional dark earth tones. These colors absorb significant amounts of solar heat during hot summer times, which penetrates through the roof deck, attic and ceiling into the house. The heat penetration increases the need for cooling energy for the indoor comfort of residence occupants.

It would be advantageous to have a roofing material/system that can reduce or prevent solar heat from penetrating the roof deck into the interior of the building. It would be even more advantageous if such a system could be used with typical shingle applications without special construction requirements.

There have been asphaltic shingles with improved solar reflectance that reduce the absorption of solar heat. Although such products lower cooling energy costs, particularly in the "sunbelt" states, they are not designed for managing solar heat during night time or changing seasons. In colder climates, such products can have heating penalties due to the loss of solar heat. This is also true for the use of radiant barriers to reduce solar heat flux into the attic, which are not designed to capture the solar heat and manage it in order to maximize the energy efficiency.

Ventilated decks or ventilation systems can reduce heat flux into the attic via air flows to carry out the heat. Again, such systems are not designed for taking the advantage of solar heat and storing them for later use during the heating period. Other products use phase change material (PCM) and adsorption and desorption of moisture from desiccants to manage solar heat. However, the cost effectiveness of such systems has not been confirmed or validated. Thus, continued improvements in thermal management are desirable.

SUMMARY

Embodiments of a system, method and apparatus for thermal energy management of a building are disclosed. For example, a building product may comprise a top layer that is substantially rigid such that it is configured to be walkable. In addition, the building product may include a radiant barrier layer configured to reflect heat, and a vent layer located between the top layer and a roof deck. The vent layer may comprise air flow channels configured to transfer heat through at least a portion of the roof product. The top layer, vent layer and radiant barrier layer can form a unitary structure.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Figure 1:
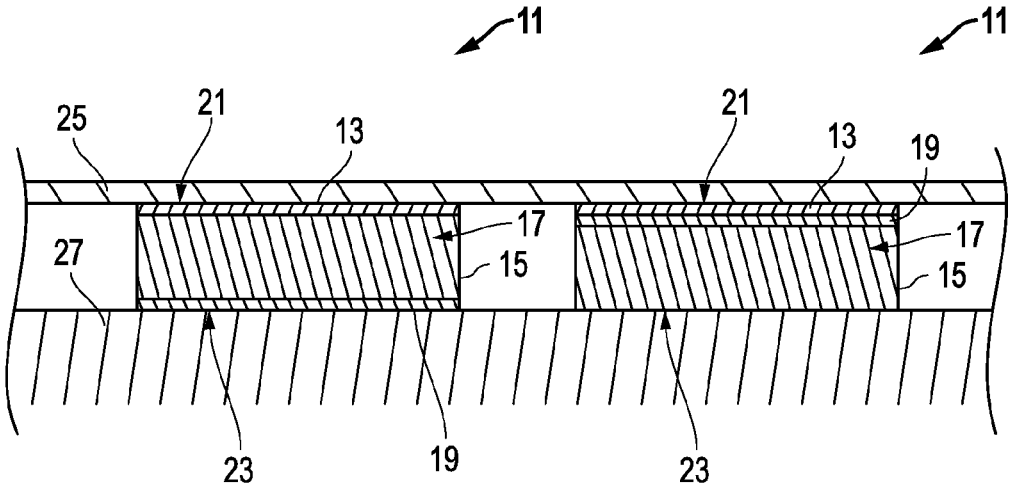
FIG. 1 is a sectional side view of an embodiment of a building product.
Figure 2:
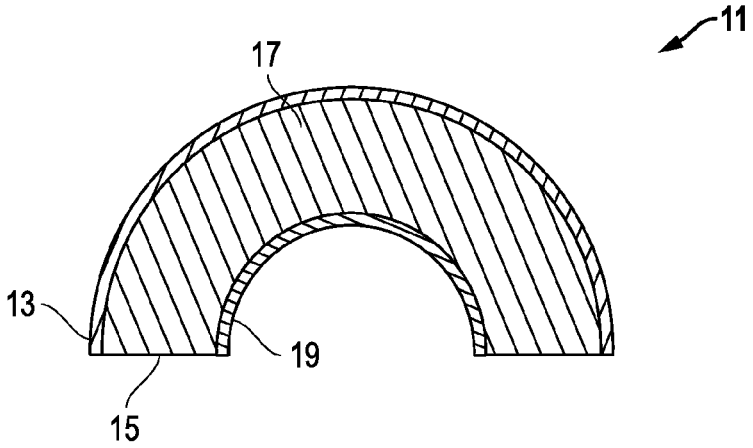
FIG. 2 is a sectional side view of another embodiment of a building product.
Figure 3:
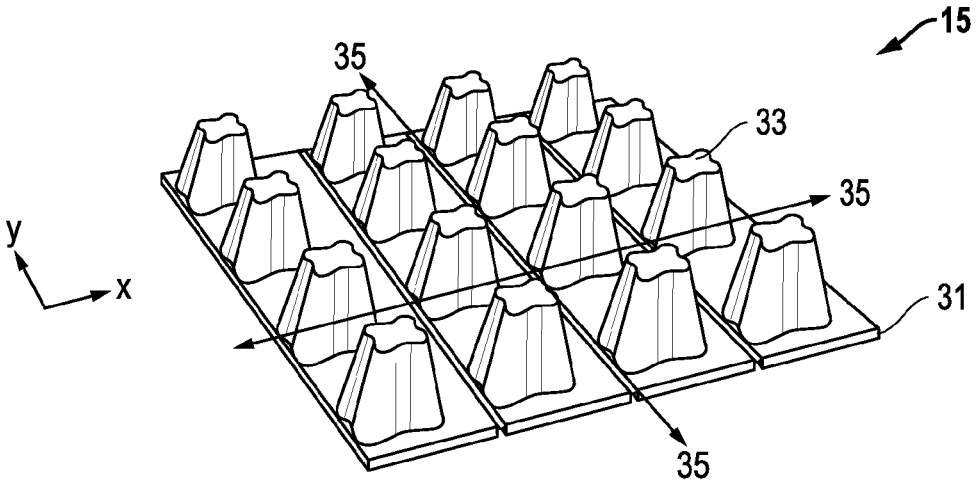
FIGS. 3 and 4 are enlarged isometric and reverse isometric views, respectively, of an embodiment of a vent layer for a building product.

Embodiments of a building product may include applications such as roofing, siding and other building application. Versions of the roofing may include a roof composite, roof product, roof shingle, roof tile, or a stand-alone layer or an underlayment layer.

In one example (FIG. 1), a building product 11 can include a top layer 13. The top layer 13 can be substantially rigid such that it is configured to be walkable. The building product 11 also may include a radiant barrier layer 19 that is configured to reflect heat. The building product 11 may further comprise a vent layer 15. Embodiments of the radiant barrier layer 19 can face the vent layer 15, and can be above or below it. Thus, vent layer 15 can be located between the top layer 13 and the radiant barrier layer 19. In another embodiment, the radiant barrier layer 19 may be located between the top layer 13 and the vent layer 15. In some applications, radiant barriers may be more effective at blocking radiant heat when they face at least one air space. If the radiant barrier layer 19 is on top of the vent layer 15, it can be configured to emit radiation. If the radiant barrier layer 19 is below the vent layer 15, it can be configured to reflect radiation, so it does not conduct heat into the structure. The vent layer 15 may include air flow channels 17 configured to transfer heat through at least a portion of the roof product 11.

In addition, the top layer 13, vent layer 15 and radiant barrier layer 19 can form a unitary structure.

Some embodiments of the building product 11 may further comprise one or more outer skin layers 21, 23 (e.g., two shown). The one or more outer skin layers 21, 23 can be on at least one of the top layer 13 or the radiant barrier layer 19. One or more of the outer skin layers 21, 23 can be at least partially permeable to moisture. One or more of the outer skin layers 21, 23 may include micro perforations. For example, the building product 11 may further include an upper radiant barrier 21 and a lower moisture barrier 23, such that the building product 11 is configured to be the only material located between the roof deck 27 and the roof barrier 25.

In one example, a lower radiant barrier 19 can provide a moisture barrier to liquid moisture while also being somewhat permeable to moisture vapor. For example, the lower radiant barrier can permit water vapor out of a building, but may be configured such that water is not permitted into the building. In addition, the lower radiant barrier can be radiant to help prevent heat from entering the building.

The building product 11 can include a structural layer configured to improve a strength of the building product 11 to install roofing materials 25 (FIG. 1). For example, the top layer 13 can be the structural layer.

In one version, the vent layer 15 can include at least one of a thermoplastic, thermoplastic elastomer, aluminum, thermoset resin, cellulose composite, wood composite or rubber. The vent layer 15 can include at least one of a filler, functional filler, flame retardant or intumescent agent. In another example, the vent layer 15 can include at least one of a biocide or a fungicide. In still other examples, the vent layer 15 may comprise at least one of an extrusion, injection molding, compression molding, pultrusion, lamination, a fused entangled filament sheet or thermal formation. In another example, the air flow channels can transfer heat reflected or emitted by the radiant barrier layer through an entire length of the roof product.

Figure 4:
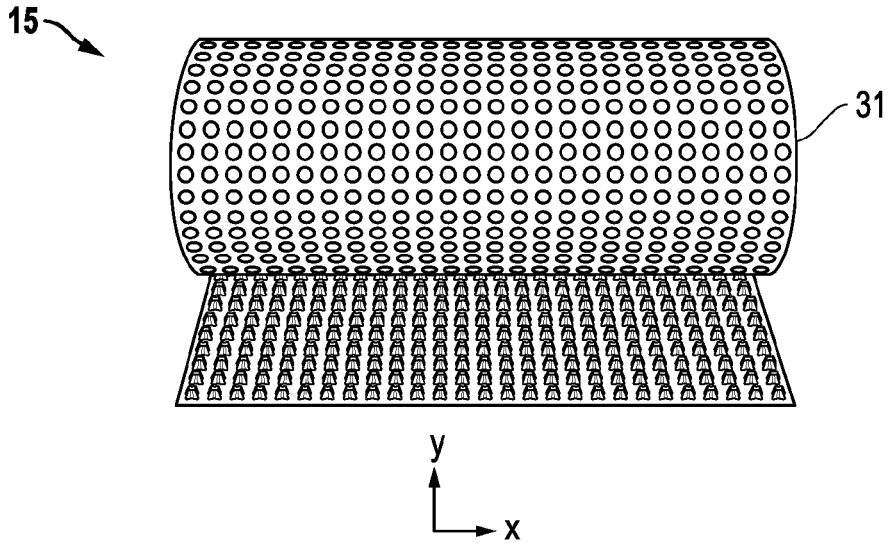
Figure 5:
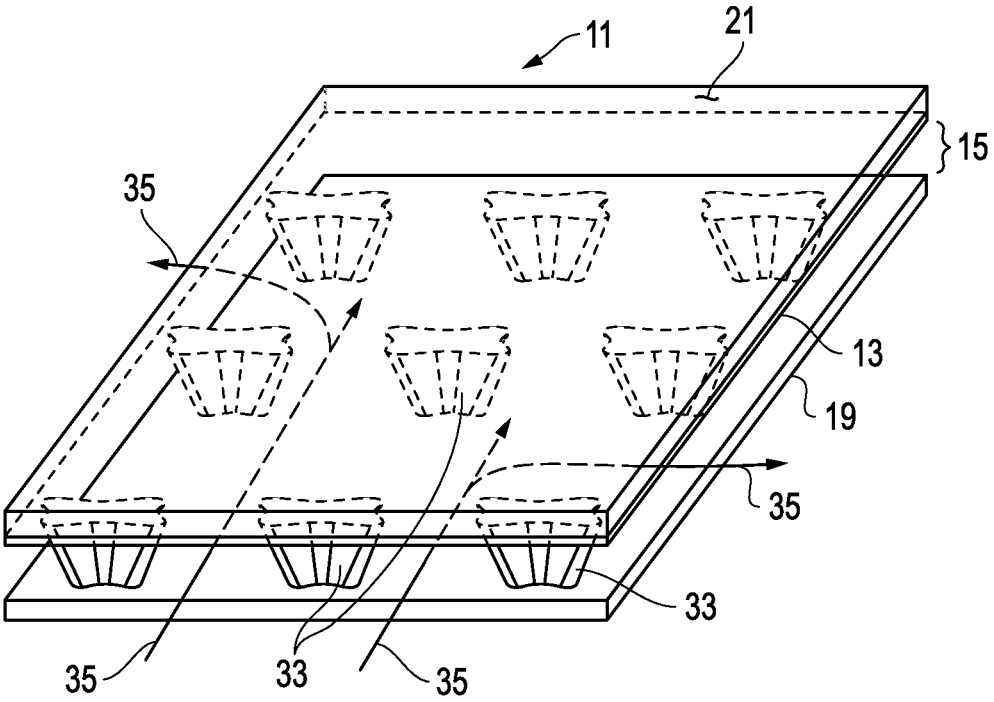
FIGS. 5 and 6 are schematic sectional isometric and sectional side views, respectively, of an embodiment of a building product.

Embodiments of the vent layer 15 may include comprises at least one of a polymer, polyvinylchloride (PVC), polypropylene (PP), high density polyethylene (PE) or nylon. The vent layer 15 also may comprise a dimpled membrane drain sheet 31 (FIGS. 3-6) having structural supports 33 that define the air flow channels 35 for air flow in an x-y plane. The vent layer 15 can be configured to enable air flow in any direction in the x-y plane. The vent layer 15 can have dimple peaks, and at least one of a foil sheet or the radiant barrier layer is attached to the dimple peaks with an adhesive or thermal bond. The dimpled membrane drain sheet 31 can be rollable, as shown in FIG. 4. An example of a dimpled membrane sheet is PS green roof drainage board D-18, available from Foshan Juhon Plastic Packaging Co., Ltd.

For the ventilation layer, a dimpled membrane drain sheet can be employed. Such sheets have structural supports molded into them that provide channels for air flow in the x-y plane of the membrane. Examples of commercially available dimpled sheets include FlexSheet by DMX Plastics, Delta-MS by Cosella-Dorken, J-Drain SWD from JDR Enterprises, Inc., VersiDrain® 8 Geo from Emlich, and Platon by Armtec and distributed by CertainTeed. Such products are generally made from high density polyethylene, but can comprise other polymers. In some embodiments, the materials for the dimpled ventilation layer may comprise recycled or recovered plastic materials from either postindustrial or post-consumer sources.

An alternative ventilation layer comprises a three dimensional entangled filament sheet such as those produced for underlaying standing seam metal roofing by Colbond USA (now Bonar) under the tradenames Enkamat and Enkatherm. In a metal roofing installation, Enkamat 7010 and 7020 are three-dimensional multi-use mats, made of continuous nylon filaments fused at their intersections. The entangled filament can be formed from polymer materials other than just nylon (e.g., polyolefin, polypropylene, recycled polypropylene, etc.). For example, the website http://www.globalplastic-sheeting.com/enkamat-enkadrain depicts some drainage sheets that include recycled polypropylene. The ventilation layer may include such an entangled filament type product.

Spacing of the roof can provide the ventilation, drainage, and thermal separation for a long service life. The polymer filaments can sustain the load of the roof and the rigors of the construction environment, including construction foot traffic. The space between the roof membrane/weather barrier underlayment and the roof deck allow moisture to flow away or evaporate.

A ventilated sheet may be provided for use under asphalt roofing shingles and other more flexible roofing products. Such can be accomplished by providing a rigid structure over the top of a ventilation layer product. One suitable material for the upper layer of the construction is GreenGuard® PB6FA, a lightweight roofing recovery board made of a high density expanded polystyrene foam core with high strength film facers on both sides, available from Pactiv. Other suitable rigid materials may include plywood, Luan, engineered wood, oriented strand board, or the like. The thickness of the rigid structure may be selected based on the application. For example, the thickness of the rigid structure can be ⅛-inch, ¼-inch, ⅜-inch, ½-inch, ¾-inch, or even 1 inch. An optional glass mat can be provided on the top surface of the construction as an aid to flame resistance.

An embodiment of the vent layer 15 may comprise a three-dimensional entangled filament sheet. The vent layer 15 can include continuous nylon filaments fused at intersections thereof. Enkatherm 5006 is a product that is a combination of fused and entangled nylon filaments formed in a 0.5" button pattern and heat bonded to an industrial pure aluminum foil. The combination radiant barrier can insulate, ventilate and drain roofing and wall applications and create a rainscreen for incidental moisture. The material can double as a weather or vapor barrier.

In addition, the vent layer 15 may comprise a rainscreen configured for incidental moisture and a vapor barrier. Embodiments of the air flow channels 17 in the vent layer 15 can have openings, and each opening can have an effective area of about 0.01 $in^2$ to about 1 $in^2$. In other versions, the effective area can be about 0.05 $in^2$ to about 0.5 $in^2$. In some examples, the radiant barrier layer 19 can have physical contact and fluid connectivity with the vent layer 15. The radiant barrier layer 19 can include at least one of metallic foil, aluminum foil, metallic fabric, aluminized sheet, metal sheet, metallic sheet, metallic film, aluminum paint, aluminum coating, reflective coating or reflective film. In one aspect, the building product 11 is configured such that the radiant barrier layer 19 is applied to and directly contacts a roof deck 27 of a building. The radiant barrier also can be positioned between the top layer 13 and the vent layer 15. The radiant barrier layer 19 can be at least one of flexible and a paint coating. In other examples, the vent layer structure can be metallized, such as, for example, with an aluminized coating or metal vapor coat. In addition, the radiant barrier layer can be moisture permeable such that it is configured to provide radiant heat management as well as moisture management for the building product. The permeable radiant barrier may also help dry plywood deck if it has gotten wet by moisture absorption.

Embodiments of the top layer 13 may comprise at least one of a recovery board, a roof cover board or recycled plastic. For example, the top layer 13 may comprise a core layer of at least one of a high density polyisocyanurate foam comprising closed cells, or an expanded polystyrene foam having a density of about 0.1 g/cm$^3$ to about 0.6 g/cm$^3$. In contrast, the commercially available product, InvinsaRoofBoard, has a density of 0.286 g/cm$^3$ for RS5500. In addition, the top layer further 13 may further comprise a facer of at least one of a film or a mineral-coated fiber glass-reinforcement. The facer can be bonded on both sides of the core layer of the top layer. In one aspect, the top layer 13 can include at least one of a flame resistant material or a glass mat.

In another embodiment, the top layer can have an insulation value (R). The insulation value R can be at least about 0.5 (hr·ft$^2$·° F.)/BTU at a thickness of ¼ inch.

Figure 7A:
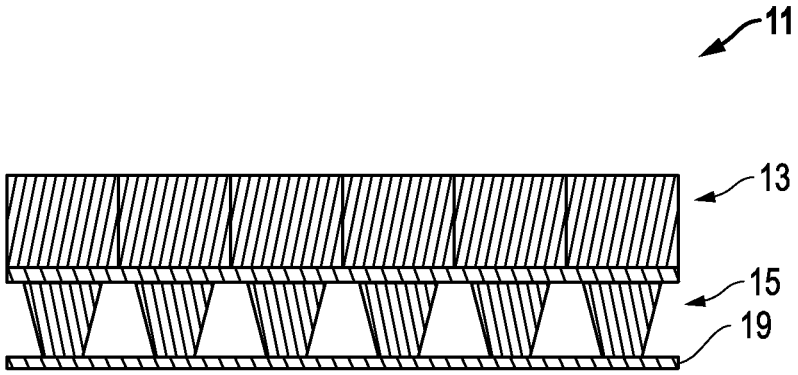
FIGS. 7A and 7B are unrolled and rolled sectional side views, respectively, of another embodiment of a building product.
Figure 7B:
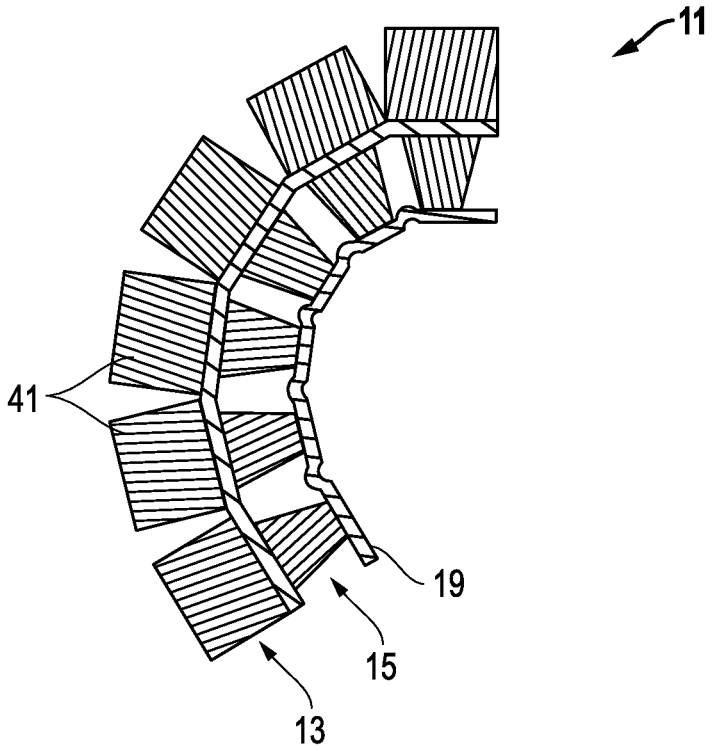
Figure 8A:
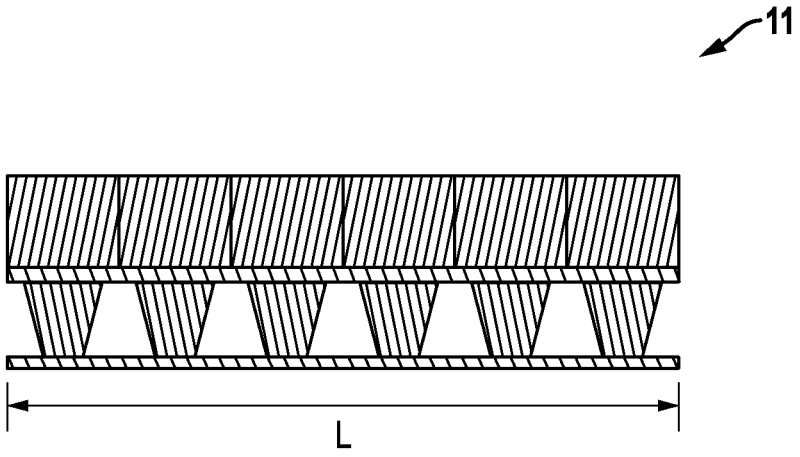
FIGS. 8A-8D are unrolled sectional side, top, and rolled sectional side views, respectively, of still another embodiment of a building product.
Figure 8B:
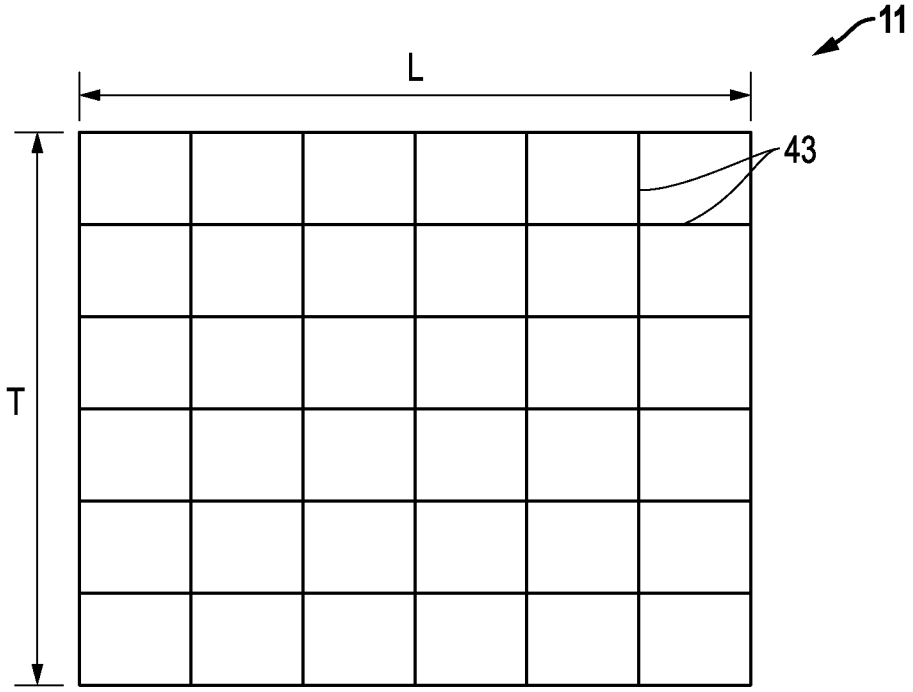
Figure 8C:
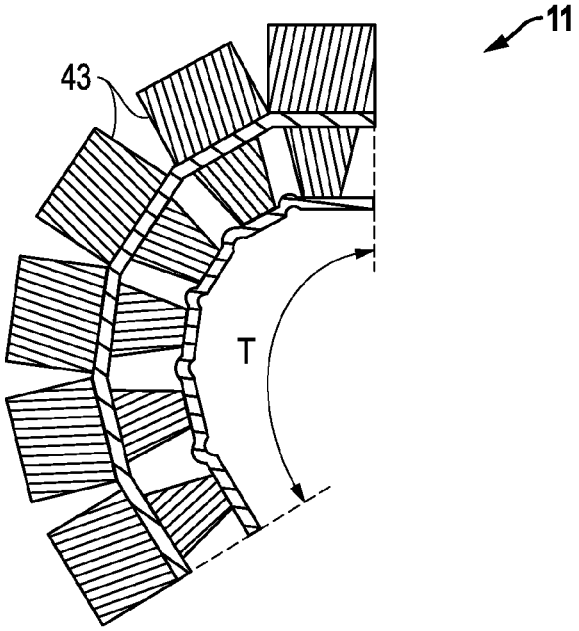
Figure 8D:
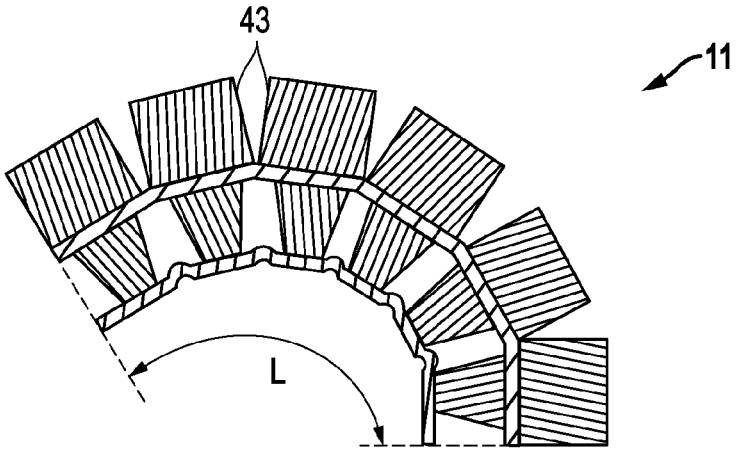

Other embodiments of the top layer 13 also can include rigid blocks, bars or slats 41 that are hinged together (compare FIGS. 7A and 7B) such that the building product 11 can be rolled and unrolled. The top layer 13 can include scores, grooves or both, which are indicated with reference numeral 43. However, for brevity, the scores, grooves or both will be referred to as grooves 43.

As shown in FIGS. 8A-8D, the grooves 43 can extend in one or more directions. For example, grooves 43 may extend a direction that is transverse T to a length L of the top layer. In another example, the grooves 43 can extend in both the transverse direction T and the length direction L of the top layer 13, such that the building product 11 is configured to be rolled up, or is rollable. Some versions of the grooves 43 may extend in a length direction L, such that the building product 11 is configured to be flexible and accommodate irregularities in a surface of a roof deck 27 (FIG. 1). Embodiments of the grooves 43 can be orthogonal to sides of the building product 11. In still other versions, the scores and/or grooves 43 can be cross-web to permit rolling up, and can also be downweb, or in another direction, to accommodate surface irregularities.

Figure 9A:
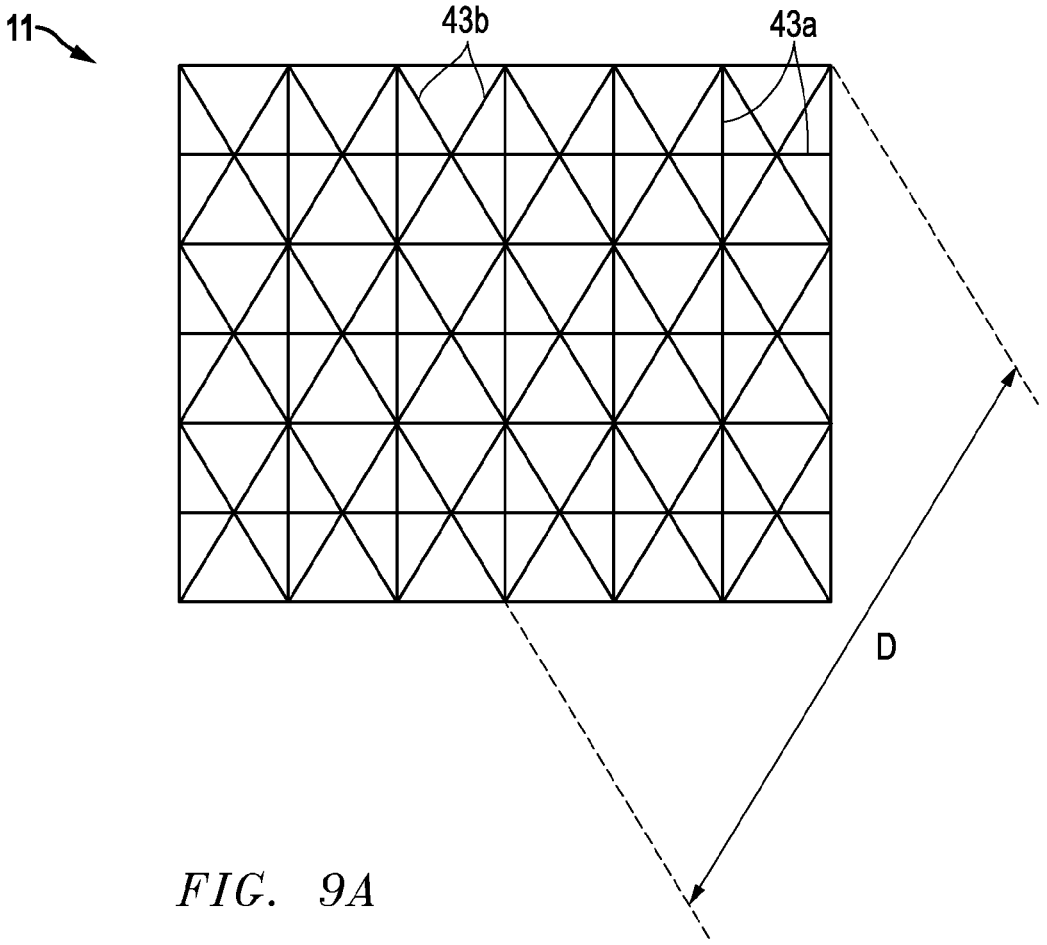
FIGS. 9A and 9B are top and rolled sectional side views, respectively, of yet another embodiment of a building product.
Figure 9B:
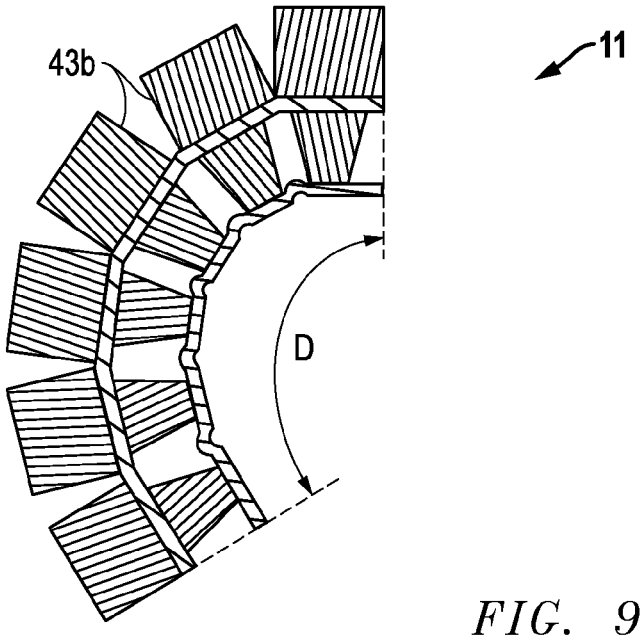

In another embodiment (FIGS. 9A and 9B), the scores or grooves 43 can be non-orthogonal (e.g., diagonal) to sides of the building product 11. In some embodiments, a spacing between at least some of the scores or grooves 43 can be uniform. However, in other embodiments, the spacing between at least some of the scores or grooves 43 can be non-uniform. In still another example, at least some of the scores or grooves 43 can be orthogonal to sides of the building product 11, and at least some of the scores or grooves 43 can be non-orthogonal to sides of the building product 11. In one aspect (best shown in FIG. 9A), a first set (horizontal) and a second set (vertical) of the scores or grooves 43*a* can be orthogonal to sides of the building product 11, and a third set and a fourth set (opposing diagonals) of the scores or grooves 43*b* can be formed therein. For example, scores or grooves 43*b* can be set at 60 degree angles relative to sides of the building product 11. The building product can be bent or rolled along line D at either of scores or grooves 43*b* (see, e.g., FIG. 9B), and also can be bent or rolled along either of scores or grooves 43*a* (see, e.g., analogous grooves 43 in FIGS. 8C and 8D).

Embodiments of the various layers of the building product 11 can have ranges of thicknesses. For example, the top layer 13 can have a thickness of at least about 0.125 inches, such as at least about 0.25 inches, or even at least about 0.5 inches. In other versions, the top layer thickness can be less than about 3 inches, such as less than about 2 inches, less than about 1.5 inches, or even less than about 1 inch. The top layer thickness can be in a range between any of these values.

Embodiments of the vent layer 15 can have a thickness of at least about 0.125 inches, such as at least about 0.25 inches, or even at least about 0.5 inches. In other versions, the vent layer thickness can be less than about 3 inches, such as less than about 2 inches, less than about 1.5 inches, or even less than about 1 inch. The vent layer thickness can be in a range between any of these values.

Embodiments of the building product 11 can further comprise a coating, such as a radiant coating on the radiant barrier layer 19. In other examples, the coating can be on either the upper or lower surface of the top layer 13, or on both surfaces. In one version, the coating is a UV-resistant coating. In another version, the coating may include a low emittance coating that can lower the thermal emissivity of the surface it is on. For example, the coating can provide an emittance that is less than 0.3, such as less than 0.25, less than 0.20, or even less than 0.14. Embodiments of the coating can have a reflectivity that is greater than about 0.5, such as greater than 0.6, or even greater than 0.7. In some versions, the coating is UV-resistant. A low emittance coating does not necessarily need to be UV resistant if it is located within the structure where it is not exposed to UV.

Figure 6:
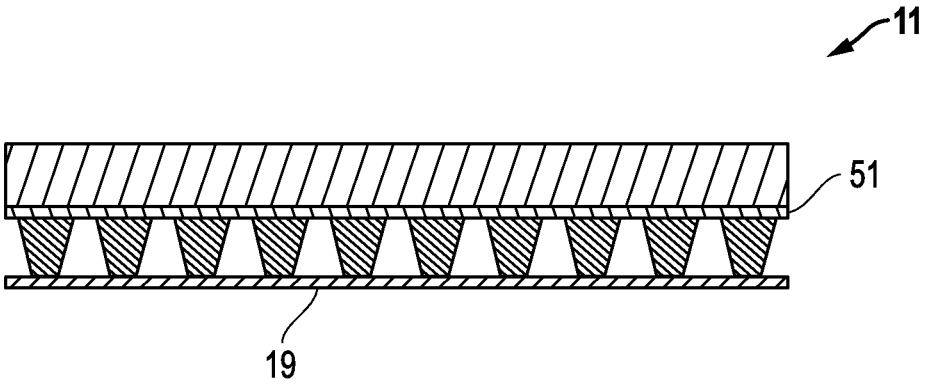

As shown in FIG. 6, other embodiments of the building product 11 may further comprise a thermal heat storage layer (THSL) 51. Versions of the THSL can have access to the vent layer and can be located: a) between the top layer and the radiant barrier layer; or b) between the vent layer and the radiant barrier layer; c) beneath the radiant barrier layer and opposite the vent layer; or any combination thereof.

In another embodiment, at least some of the THSL material may be located inside the supports 33. The THSL material may at least partially fill the supports 33, such that they may be located within the vent layer 15. Such a configuration may provide additional functionality. For example, the volume within the supports 33 may contain or encapsulate phase change material (PCM) or desiccant material. If a desiccant is located inside the supports 33, at least some of the walls could have moisture vapor transmission capability. In another example, the shell of the walls of the support leg structures 33 could contain, for instance, a PCM which could melt to liquid state and be maintained in place when it changes back to a solid.

Embodiments of the THSL can have a heat capacity configured to store solar heat during a heating cycle. In one aspect, the THSL can have a thermal emittance configured to re-radiate stored heat during a cooling cycle. In another example, the THSL can include at least one of phase change material (PCM), paraffin, hydrated salt, stearic acid or ceramic media. For example, the PCM may comprise at least one of calcium chloride hexahydrate, sodium sulfate, $Na_2SO_4.10H_2O$, $CaCl_2.6H_2O$, $Na_2S_2O_3.5H_2O$, $Na_2CO_3.10H_2O$, $NaHPO_4.12H_2O$, strontium chloride hexahydrate, potassium chloride or calcium chloride.

In another embodiment, the THSL can have a heat capacity greater than about 100 kJ/kg, and a heat absorbing range of about 10° C. to about 50° C. Alternatively, the THSL can have a heat capacity greater than about 200 kJ/kg, and a heat absorbing range of about 20° C. to about 40° C. Versions of the THSL may include at least one of a powder or an encapsulated form. In another version, the THSL can have an average particle size of less than about 0.5 mm. In addition, the THSL can comprise media located between skin layers described herein.

Furthermore, embodiments of the building product 11 may include at least two of the layers being combined together. For example, a flame retardant may be combined with the THSL. The flame retardant and the THSL may each comprise media, and the media can be mixed and combined in a single layer. In an example, the single layer may comprise less than about 25% of the flame retardant. Alternatively, the single layer can comprise less than about 5%, or even less than about 10% of the flame retardant.

Embodiments of a shell of the supports 33 with a dimple membrane type material could have at least some of them filled with PCM or THSL. Other ones of the supports 33 may be filled with flame retardant and/or intumescent materials. Use of the supports 33 may provide reservoirs of different kinds of functional materials, either individually isolated, or in mixtures.

In still another embodiment, the building product 11 may further comprise a flame retardant structure for the air flow channels 17 of the vent layer 15. The flame retardant structure and the vent layer 15 may be combined in a single layer.

Figure 10A:
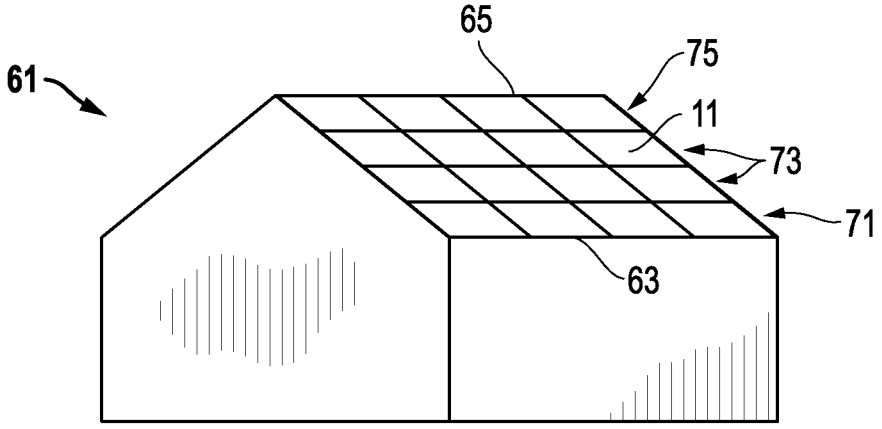
FIGS. 10A and 10B are schematic isometric views of a building having embodiments of roof products.
Figure 10B:
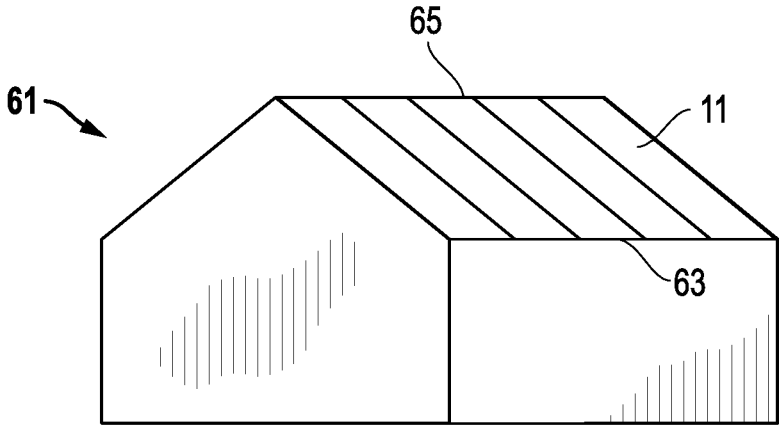

Embodiments of the building product 11 may comprise a rigid sheet 11, a rigid panel 11 in courses or rows 73 (FIG. 10A) or a flexible roll 11 in rows or columns (FIG. 10B). The building product 11 can be adapted to be attached to roof underlayment with fasteners or adhesives. Embodiments of a plurality of the vent layers 15 can be configured to vent excess heat from an eave 63 of a roof 71 up to a ridge 65 of the roof 71 and out to atmosphere. In another embodiment, a plurality of the vent layers 15 can be configured to vent heat via natural air flow from a lower eave 63 of a roof 71 up to a ridge 65 of the roof 71.

In one aspect, the building product 11 may further comprise a flame retardant having an intumescent that expands into the vent layer 15 at a temperature in a range of about 175° C. to about 280° C. The flame retardant may include an accessory that is configured to be applied to the building product 11 near an entry or exit of the vent layer 15. For example, the flame retardant can include at least one of a glass mat, expandable clay, expandable graphite, intumescent silicate, hydrated metal silicate, bromated compound, halocarbon, aluminum hydroxide, magnesium hydroxide, hydromagnesite, antimony trioxide, hydrate, red phosphorus, boron compound or phosphonium salt.

Embodiments of the building product 11 can be configured to be flexible at a temperature of about 0° C. Moreover, embodiments of the building product 11 can be structurally sound to provide a roof walkable surface at a temperature in excess of about 70° C. The building product 11 can be directly nailable for roofing shingles 25 (FIG. 1) on top thereof without substantially affecting an overall thickness of the building product 11.

Other embodiments may be configured with sufficient strength and structural integrity such that when nailing a roofing product thereon, nail blow through of the roofing product is avoided. For example, the building product 11 can support a roofing shingle 25 in a sufficient manner such that a pneumatic nail gun will not drive nails further through the shingle than it should. This design can avoid the formation of excessive holes and leakage through the shingle.

Figure 11:
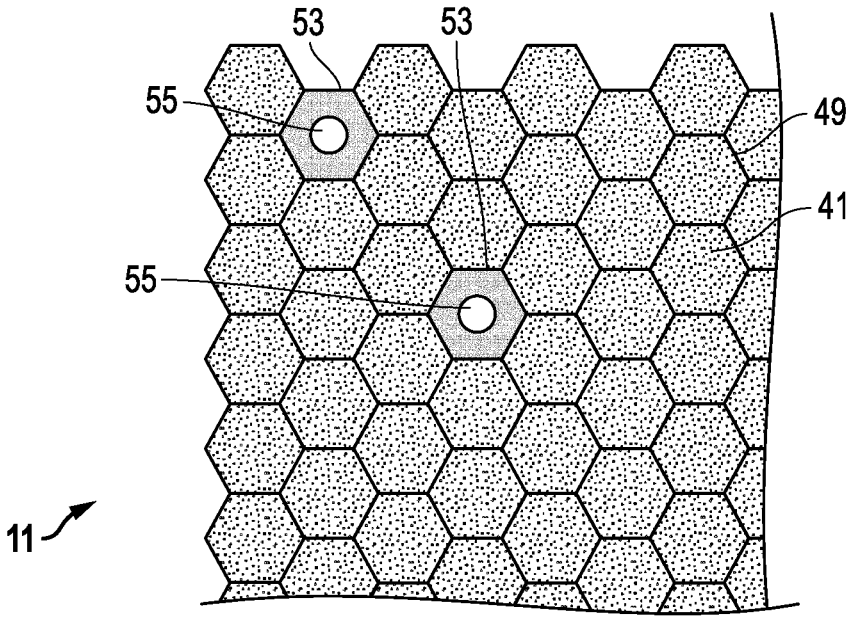
FIG. 11 is an enlarged top view of an embodiment of a roof product.

FIG. 11 depicts an embodiment of a building product wherein a material or media 41, as described herein, is located in a structure 49 having an array of cavities. In one aspect, the building product 11 can have has a plurality of cells 53 configured to be penetrated by roofing fasteners 55. The cells 53 may be void of a material 41 used to form the THSL, as described herein.

Versions of the building product can have an overall thickness. For example, the overall thickness of the building product can be about 0.75 inches to about 2.5 inches. In another version, the THSL can have a thickness of about 0.25 inches to about 1 inch. In still another version, the vent layer can have a thickness of about 0.25 inches to about 1 inch. In another embodiment, the flame retardant can have a thickness of about 0.25 inches to about 0.5 inches. In addition, the flame retardant thickness can be set based on a ratio with respect to the vent layer thickness.

In other versions, the building product can have a weight in a range of about 0.5 lbs/ft$^2$ to about 10 lbs/ft$^2$.

In one embodiment, at least one of the top layer or the radiant barrier can have a first surface area, and the vent layer can have a second surface area that is less than the first surface area. Accordingly, said at least one of the top layer and the radiant barrier can have an extension that extends beyond at least one side edge of the vent layer. In one version, the extension may include at least one of an overlap, underlap, shiplap, tongue, groove or flange.

Embodiments of a roof for a building can include a roof deck 27 (FIG. 1) and a plurality of roof products 11 mounted to the roof deck 27. Each of the roof products 11 may includes top layer that is substantially rigid such that it is walkable, an optional radiant barrier layer configured to reflect heat, and a vent layer located between the top layer and the radiant barrier layer, the vent layer has air flow channels configured to transfer heat through at least a portion of the roof product. The top layer, vent layer and radiant barrier layer can form a unitary structure. In addition, the roof can include a plurality of outer roof barriers 25 mounted to the roof deck 27 such that the roof products 11 are positioned between the roof deck 27 and the outer roof barriers 25.

In an example of a roof, the channels 17 of the vent layers 15 can form contiguous, uninterrupted air flow paths between abutting roof products 11 having inlets only adjacent an eave 63 (FIGS. 10A and 10B) of the roof and outlets only adjacent a ridge 65 of the roof. The roof products 11 can include rolls of material that extend continuously (FIG. 10B) from adjacent the eave of the roof to adjacent a ridge of the roof to form continuous, uninterrupted air flow paths having inlets only adjacent the eave and outlets only adjacent the ridge. There may or may not be air flow communication in the channels between adjacent lateral rolls.

Embodiments of a roof composite for reducing solar heat may comprise a top layer, a middle layer providing air movement to vent out the heat, and a radiant barrier layer where the heat can be reflected and carried out by the air flow. Additional multi-layer configuration where other functional layer, such as a skin layer with proper moisture permeability, a layer of heat storing materials to mitigate heat flux, or a structural layer for improving strength, or their combinations, can also be included in the composite. Other variations may become apparent to those who are skilled in the art. The roofing composite can be a sheet form, a roll form, a three dimensional structural shape, or as part of existing roofing shingle or tile configuration. The roof composite can be applied as stand-alone layer on roof deck prior to shingle installation, or can be as an underlayment layer.

Further embodiments of a roof composite for reducing solar heat may comprise a top layer, a middle layer providing air movement to vent out the heat, and a bottom layer where the heat can be carried out by the air flow. Additional multi-layer configurations may include one or more other functional layers, such as a skin layer with proper moisture permeability, a layer of heat storing materials to mitigate heat flux, and a structural layer for improving strength. Any combination of these layers also can be included in the composite. Other variations may become apparent to those skilled in the art. The roofing composite can be a sheet form, a roll form, a three-dimensional structural shape, or a part of an existing roofing shingle or tile configuration. The roof composite can be applied as a stand-alone layer on a roof deck prior to shingle installation, or can be as an underlayment layer for a shingle or other types of outer barriers.

The top layer may provide a surface where the roofing materials, such as shingles or shakes, can be directly applied via conventional construction practice, such as nailing, stabling, or adhesives. The top layer can have adequate rigidity for workers to be able to stand upon for shingle applications and prevent the shingle attachment such as nails or stables to blow through the shingle, as they may be applied by pneumatic air gun typically employed in the roofing industry. Also, the top layer can provide insulation value to prevent heat from passing down into the layers below. The top layer can also have additional functionality such as fire resistance by incorporating glassmats; moisture permeability to allow trapped water to be evaporated via the venting layer below; or incorporating fire retardant to prevent fire spreading through the venting layer below. This can be done by adding intumescent fire retardants that can rapidly expand upon fire to block all the air passage. The top layer also can provide adequate holding power to the shingle attachment such as nails or stables to prevent them from wind blow-offs. Other variations to the construction of the said roof deck composite for managing solar heat will become apparent to those who are skilled in the art.

While the ventilation layers by themselves may provide benefit in a metal roofing installation, they lack apparent rigidity and strength to work effectively with asphalt roofing shingles. The flexing and deformation of the sheets can impart a level of instability and discomfort to a roofer working on the roof. Also, asphalt shingle installation using pneumatic nail guns is not practical with such materials as the nail heads would not be adequately supported under the shingle causing nails to blow through the shingle and cause potential leaks.

Other embodiments may include one or more of the following items:

Item 1. A building product, comprising:

a top layer that is substantially rigid such that it is configured to be walkable;

a radiant barrier layer configured to reflect heat;

a vent layer having air flow channels configured to transfer heat through at least a portion of the building product; and the top layer, vent layer and radiant barrier layer form a unitary structure.

Item 2. The building product of Item 1, further comprising an outer skin layer on the building product.

Item 3. The building product of Item 2, wherein the outer skin layer is on at least one of the top layer and the radiant barrier layer.

Item 4. The building product of Item 2, wherein the outer skin layer is at least partially permeable to moisture.

Item 5. The building product of Item 2, wherein the outer skin layer comprises micro perforations.

Item 6. The building product of Item 1, comprising a structural layer configured to improve a strength of the building product to install roofing materials.

Item 7. The building product of Item 6, wherein the top layer is the structural layer.

Item 8. The building product of Item 1, wherein the vent layer comprises at least one of a thermoplastic, thermoplastic elastomer, aluminum, thermoset resin, cellulose composite, wood composite and rubber.

Item 9. The building product of Item 1, wherein the vent layer comprises at least one of a filler, functional filler, flame retardant and intumescent agent.

Item 10. The building product of Item 1, wherein the vent layer comprises at least one of a biocide and a fungicide.

Item 11. The building product of Item 1, wherein the vent layer comprises at least one of an extrusion, injection molding, compression molding, pultrusion, lamination, a fused entangled filament sheet and thermal formation.

Item 12. The building product of Item 1, wherein the radiant barrier layer has physical contact and fluid connectivity with the vent layer.

Item 13. The building product of Item 1, wherein the radiant barrier layer comprises at least one of metallic foil, aluminum foil, metallic fabric, aluminized sheet, metal sheet, metallic sheet, metallic film, aluminum paint, aluminum coating, low-emittance coating, reflective coating and reflective film.

Item 14. The building product of Item 1, wherein the building product is configured such that the radiant barrier layer is applied to and directly contacts at least one of the top layer and a roof deck of a building.

Item 15. The building product of Item 1, wherein the vent layer comprises at least one of a polymer, polyvinylchloride (PVC), polypropylene (PP), high density polyethylene (PE) and nylon.

Item 16. The building product of Item 1, wherein the vent layer comprises a dimpled membrane drain sheet having structural supports that define the air flow channels for air flow in an x-y plane.

Item 17. The building product of Item 16, wherein the vent layer is configured to enable air flow in any direction in the x-y plane.

Item 18. The building product of Item 16, wherein the vent layer has dimple peaks, and at least one of a foil sheet and the radiant barrier layer is attached to the dimple peaks with an adhesive or thermal bond.

Item 19. The building product of Item 16, wherein the dimpled membrane drain sheet is rollable.

Item 20. The building product of Item 1, wherein the vent layer comprises a three-dimensional entangled filament sheet.

Item 21. The building product of Item 1, wherein the vent layer comprises continuous nylon filaments fused at intersections thereof.

Item 22. The building product of Item 1, wherein the vent layer comprises a rainscreen configured for incidental moisture and a vapor barrier.

Item 23. The building product of Item 1, wherein the radiant barrier layer is at least one of flexible and a paint coating.

Item 24. The building product of Item 1, wherein the top layer comprises at least one of a recovery board, a roof cover board and recycled plastic.

Item 25. The building product of Item 1, wherein the top layer comprises a core layer of at least one of a high density polyisocyanurate foam comprising closed cells, and an expanded polystyrene foam having a density of about 0.1 $g/cm^3$ to about 0.6 $g/cm^3$.

Item 26. The building product of Item 25, wherein the top layer further comprises a facer of at least one of a film and a mineral-coated fiber glass-reinforcement.

Item 27. The building product of Item 26, wherein the facer is bonded on both sides of the core layer of the top layer.

Item 28. The building product of Item 1, wherein the top layer comprises at least one of a flame resistant material and a glass mat.

Item 29. The building product of Item 1, wherein the top layer comprises at least one of rigid blocks, bars and slats that are hinged together such that the building product can be rolled and unrolled.

Item 30. The building product of Item 1, wherein the top layer has at least one of scores and grooves.

Item 31. The building product of Item 30, wherein said at least one of the scores and grooves extends in a direction transverse to a length of the top layer.

Item 32. The building product of Item 30, wherein said at least one of the scores and grooves extends in a plurality of directions.

Item 33. The building product of Item 30, wherein said at least one of the scores and grooves extends in a direction transverse to a length of the top layer, such that the building product is configured to be rolled up, and said at least one of the scores and grooves extends in a length direction, such that the building product is configured to be flexible and accommodate irregularities in a roof deck surface.

Item 34. The building product of Item 30, wherein said at least one of the scores and grooves is orthogonal to sides of the building product.

Item 35. The building product of Item 30, wherein said at least one of the scores and grooves is non-orthogonal to sides of the building product.

Item 36. The building product of Item 30, wherein a spacing is uniform between at least some of said at least one of the scores and grooves.

Item 37. The building product of Item 30, wherein a spacing between at least some of said at least one of the scores and grooves is non-uniform.

Item 38. The building product of Item 30, wherein at least some of said at least one of the scores and grooves are orthogonal to sides of the building product, and at least some of said at least one of the scores and grooves are non-orthogonal to sides of the building product.

Item 39. The building product of Item 38, wherein a first set of said at least one of the scores and grooves is orthogonal to sides of the building product, and a second set and a third set of said at least one of the scores and grooves are at 60 degree angles relative to sides of the building product.

Item 40. The building product of Item 1, wherein the top layer has a thickness of at least about 0.125 inches, at least about 0.25 inches, at least about 0.5 inches, and less than about 3 inches, less than about 2 inches, less than about 1.5 inches, or less than about 1 inch.

Item 41. The building product of Item 1, wherein the vent layer has a thickness of at least about 0.125 inches, at least about 0.25 inches, at least about 0.5 inches, and less than about 3 inches, less than about 2 inches, less than about 1.5 inches, or less than about 1 inch.

Item 42. The building product of Item 1, further comprising a coating on at least one of an upper surface of the top layer and an inner surface of the top layer.

Item 43. The building product of Item 42, wherein the coating is a UV-resistant coating, and the coating is a low-emittance coating that lowers an emittance of the surface it is on to less than 0.25.

Item 44. The building product of Item 1, further comprising a thermal heat storage layer (THSL).

Item 45. The building product of Item 44, wherein the THSL has access to the vent layer and is located:

a) between the top layer and the radiant barrier layer; or
b) between the vent layer and the radiant barrier layer; or
c) beneath the radiant barrier layer and opposite the vent layer.

Item 46. The building product of Item 1, wherein at least two of the layers are combined together.

Item 47. The building product of Item 44, wherein a flame retardant is combined with the THSL.

Item 48. The building product of Item 47, wherein the flame retardant and the THSL each comprise media, and the media are mixed and combined in a single layer.

Item 49. The building product of Item 48, wherein the single layer comprises less than about 25% of the flame retardant.

Item 50. The building product of Item 48, wherein the single layer comprises less than about 5%, or less than about 10% of the flame retardant.

Item 51. The building product of Item 1, further comprising a flame retardant structure for the air flow channels of the vent layer, and the flame retardant structure and the vent layer are combined in a single layer.

Item 52. The building product of Item 1, wherein the building product comprises a rigid sheet, a rigid panel or a flexible roll.

Item 53. The building product of Item 1, wherein the building product is adapted to be attached to roof underlayment with fasteners or adhesives.

Item 54. The building product of Item 1, wherein a plurality of the vent layers is configured to vent excess heat from an eave of a roof up to a ridge of the roof and out to atmosphere.

Item 55. The building product of Item 1, wherein a plurality of the vent layers is configured to vent heat via natural air flow from a lower eave of a roof up to a ridge of the roof.

Item 56. The building product of Item 1, further comprising a flame retardant having an intumescent that expands into the vent layer at a temperature in a range of about 175° C. to about 280° C.

Item 57. The building product of Item 56, wherein the flame retardant comprises an accessory that is configured to be applied to the building product near an entry or exit of the vent layer.

Item 58. The building product of Item 1, further comprising a flame retardant having at least one of a glass mat, expandable clay, expandable graphite, intumescent silicate, hydrated metal silicate, bromated compound, halocarbon, aluminum hydroxide, magnesium hydroxide, hydromagnesite, antimony trioxide, hydrate, red phosphorus, boron compound or phosphonium salt.

Item 59. The building product of Item 1, wherein the building product is configured to be flexible at a temperature of about 0° C., and is structurally sound to provide a walkable roof surface at a temperature in excess of about 70° C.

Item 60. The building product of Item 1, wherein the building product is directly nailable for roofing shingles on top thereof without substantially affecting an overall thickness of the building product.

Item 61. The building product of Item 44, wherein the THSL has a heat capacity configured to store solar heat during a heating cycle, and the THSL has a thermal emittance configured to re-radiate stored heat during a cooling cycle.

Item 62. The building product of Item 44, wherein the THSL comprises at least one of phase change material (PCM), paraffin, hydrated salt, stearic acid, desiccant or ceramic media.

Item 63. The building product of Item 62, wherein the PCM comprises at least one of calcium chloride hexahydrate, sodium sulfate, $Na_2SO_4.10H_2O$, $CaCl_2.6H_2O$, $Na_2S_2O_3.5H_2O$, $Na_2CO_3.10H_2O$, $NaHPO_4.12H_2O$, strontium chloride hexahydrate, potassium chloride or calcium chloride.

Item 64. The building product of Item 44, wherein the THSL has a heat capacity greater than about 100 kJ/kg, and a heat absorbing range of about 10° C. to about 50° C.

Item 65. The building product of Item 44, wherein the THSL has a heat capacity greater than about 200 kJ/kg, and a heat absorbing range of about 20° C. to about 40° C.

Item 66. The building product of Item 44, wherein the THSL comprises at least one of a powder or an encapsulated form.

Item 67. The building product of Item 44, wherein the THSL has an average particle size of less than about 0.5 mm.

Item 68. The building product of Item 44, wherein the THSL comprises media located between skin layers.

Item 69. The building product of Item 1, wherein the vent layer further comprises structural supports.

Item 70. The building product of Item 1, wherein the air flow channels in the vent layer have openings, and each opening has an effective area of about 0.01 $in^2$ to about 1 $in^2$.

Item 71. The building product of Item 70, wherein the effective area is about 0.05 $in^2$ to about 0.5 $in^2$.

Item 72. The building product of Item 1, wherein the building product has a plurality of cells configured to be penetrated by roofing fasteners.

Item 73. The building product of Item 72, wherein the cells are void of a material used to form a thermal heat storage layer (THSL).

Item 74. The building product of Item 1, wherein the building product includes an upper radiant barrier and a lower moisture barrier, such that the building product is configured to be the only material located between a roof deck and a roof barrier.

Item 75. The building product of Item 1, wherein the building product has an overall thickness of about 0.75 inches to about 2.5 inches.

Item 76. The building product of Item 44, wherein the THSL has a thickness of about 0.25 inches to about 1 inch, the vent layer has a thickness of about 0.25 inches to about 1 inch, and the flame retardant has a thickness of about 0.25 inches to about 0.5 inches, and a flame retardant thickness is set based on a ratio with respect to the vent layer thickness.

Item 77. The building product of Item 1, wherein the building product has a weight in a range of about 0.5 $lbs/ft^2$ to about 10 $lbs/ft^2$.

Item 78. The building product of Item 1, wherein at least one of the top layer or the radiant barrier has a first surface area, and the vent layer has a second surface area that is less than the first surface area, such that said at least one of the top layer and the radiant barrier has an extension that extends beyond at least one side edge of the vent layer.

Item 79. The building product of Item 78, wherein the extension comprises at least one of an overlap, underlap, shiplap, tongue, groove or flange.

Item 80. The building product of Item 1, further comprising outer skin layers comprising an uppermost layer and a lowermost layer on the unitary structure.

Item 81. The building product of Item 1, wherein the building product comprises a roof product, a roof shingle, a roof tile, a stand-alone layer or an underlayment layer.

Item 82. The building product of Item 1, wherein the top layer has an insulation value (R), and R=at least about 0.5 ($hr \cdot ft^2 \cdot$° F.)/BTU at a thickness of ¼ inch.

Item 83. The building product of Item 1, wherein the air flow channels transfer heat reflected or emitted by the radiant barrier layer through an entire length of the roof product.

Item 84. The building product of Item 1, wherein the radiant barrier layer is moisture permeable such that it is configured to provide radiant heat management as well as moisture management for the building product.

Item 85. A roof for a building, comprising:

a roof deck;

a plurality of roof products mounted to the roof deck, each of the roof products comprising:

a top layer that is substantially rigid such that it is walkable;

a radiant barrier layer configured to reflect heat;

a vent layer having air flow channels configured to transfer heat through at least a portion of the roof product; and the top layer, vent layer and radiant barrier layer form a unitary structure; and a plurality of outer roof barriers mounted to the roof deck such that the roof products are positioned between the roof deck and the outer roof barriers.

Item 86. A roof according to Item 85, wherein the channels of the vent layers form contiguous, uninterrupted air flow paths between abutting roof products having inlets only adjacent an eave of the roof and outlets only adjacent a ridge of the roof.

Item 87. A roof according to Item 85, wherein the roof products comprise rolls of material that extend continuously from adjacent an eave of the roof to adjacent a ridge of the roof to form continuous, uninterrupted air flow paths having inlets only adjacent the eave and outlets only adjacent the ridge, and there is no air flow communication in the channels between adjacent lateral rolls.

Item 88. A roof according to Item 85, wherein the roof products have lower moisture barriers, such that the roof products comprise an only component located between the roof deck and the roof barriers.

Item 89. A roof according to Item 85, wherein the roof products have a weight in a range of about 1 pound per square foot to about 10 pounds per square foot.

Item 90. A method of forming a building product, comprising:

providing a top layer that is substantially rigid such that it is configured to be walkable;

providing a radiant barrier layer configured to reflect heat;

providing a vent layer comprising air flow channels configured to transfer heat through at least a portion of the roof product; and assembling the top layer, vent layer and radiant barrier layer to form a unitary structure.

Item 91. A method of roofing a building, comprising:

providing a roof deck;

mounting a plurality of roof products to the roof deck, each of the roof products comprising:

a top layer that is substantially rigid such that it is walkable;

a radiant barrier layer configured to reflect heat;

a vent layer and the radiant barrier located between the top layer and the roof deck, the vent layer has air flow channels configured to transfer heat through at least a portion of the roof product; and the top layer, vent layer and radiant barrier layer form a unitary structure; and then applying a plurality of outer roof barriers mounted to the roof deck such that the roof products are positioned between the roof deck and the outer roof barriers.

Item 92. The building product of Item 69, wherein the structural supports comprise a media.

Item 93. The building product of Item 92, wherein the media forms walls of at least some of the structural supports.

Item 94. The building product of Item 69, wherein a media is located inside the structural supports.

Item 95. The building product of Item 69, wherein the structural supports comprise a media; and the media comprises at least one of a phase change material (PCM), thermal heat storage layer (THSL), a flame retardant and an intumescent.

Item 96. A building product, comprising:

a top layer that is substantially rigid such that it is configured to be walkable;

a vent layer having air flow channels configured to transfer heat through at least a portion of the building product; and the top layer and vent layer form a unitary structure.

Item 97. The building product of Item 96, wherein the building product is rollable.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A building product, comprising:

a top layer that is rigid such that it is configured to be walkable, the building product is configured to be rolled up, and configured to be flexible and accommodate irregularities in a roof deck surface;

a radiant barrier layer configured to reflect heat;

a vent layer having air flow channels configured to transfer heat through at least a portion of the building product;

the top layer, vent layer and radiant barrier layer form a unitary structure; and an outer skin layer on the building product, and the outer skin layer is at least partially permeable to moisture such that it is configured to provide moisture management for the building product;

a thermal heat storage layer (THSL) in the vent layer, and the THSL has access to the vent layer and is located:

a) between the top layer and the radiant barrier layer; or b) between the vent layer and the radiant barrier layer; or c) beneath the radiant barrier layer and opposite the vent layer; wherein the building product comprises a rigid sheet, a rigid panel or a flexible roll;

at least two of the layers are combined together; and the THSL has a heat capacity greater than 100 kJ/kg, and a heat absorbing range of 10° C. to 50° C.

2. A building product, comprising:

a top layer that is rigid such that it is configured to be walkable, the building product is configured to be rolled up, and configured to be flexible and accommodate irregularities in a roof deck surface;

a radiant barrier layer configured to reflect heat;

a vent layer having air flow channels configured to transfer heat through at least a portion of the building product;

the top layer, vent layer and radiant barrier layer form a unitary structure; and an outer skin layer on the building product, and the outer skin layer is at least partially permeable to moisture such that it is configured to provide moisture management for the building product;

a thermal heat storage layer (THSL) in the vent layer, and the THSL has access to the vent layer and is located:

a) between the top layer and the radiant barrier layer; or
b) between the vent layer and the radiant barrier layer; or
c) beneath the radiant barrier layer and opposite the vent layer;

wherein the building product is configured to be flexible at a temperature of about 0° C., and is structurally sound to provide a walkable roof surface at a temperature in excess of 70° C.;

a flame retardant is combined with the THSL, wherein the flame retardant and the THSL each comprise media, and the media are mixed and combined in a single layer; and the THSL has a heat capacity greater than 200 kJ/kg, and a heat absorbing range of 20° C. to 40° C.

3. A building product, comprising:

a top layer that is rigid such that it is configured to be walkable, the building product is configured to be rolled up, and configured to be flexible and accommodate irregularities in a roof deck surface;

a radiant barrier layer configured to reflect heat;

a vent layer having air flow channels configured to transfer heat through at least a portion of the building product;

the top layer, vent layer and radiant barrier layer form a unitary structure; and an outer skin layer on the building product, and the outer skin layer is at least partially permeable to moisture such that it is configured to provide moisture management for the building product;

a thermal heat storage layer (THSL) in the vent layer, and the THSL has access to the vent layer and is located:

a) between the top layer and the radiant barrier layer; or
b) between the vent layer and the radiant barrier layer; or
c) beneath the radiant barrier layer and opposite the vent layer;

wherein the air flow channels in the vent layer have openings, and each opening has an effective area of 0.01 $in^2$ to 1 $in^2$;

the THSL comprises at least one of phase change material (PCM), paraffin, hydrated salt, stearic acid, desiccant or ceramic media; and the THSL has an average particle size of less than 0.5 mm.

4. The building product of claim 3, wherein at least one of the top layer or the radiant barrier has a first surface area, and the vent layer has a second surface area that is less than the first surface area, such that said at least one of the top layer and the radiant barrier has an extension that extends beyond at least one side edge of the vent layer;

the PCM comprises at least one of calcium chloride hexahydrate, sodium sulfate, $Na_2SO_4.10H_2O$, $CaCl_2.6H_2O$, $Na_2S_2O_3.5H_2O$, $Na_2CO_3.10H_2O$, $NaHPO_4.12H_2O$, strontium chloride hexahydrate, potassium chloride or calcium chloride;

the radiant barrier layer is an upper radiant barrier that is moisture permeable such that it is configured to provide radiant heat management as well as moisture management for the building product; and the building product further comprises a lower moisture barrier, such that the building product is configured to be the only material located between a roof deck and a roof barrier.

5. A roof for a building, comprising:

a roof deck;

a plurality of roof products mounted to the roof deck, each of the roof products comprising:

a top layer that is rigid such that it is walkable;

a radiant barrier layer configured to reflect heat;

a vent layer having structural supports that define air flow channels configured to transfer heat through at least a portion of the roof product;

a thermal heat storage layer (THSL) comprising a material located inside the structural supports;

an intumescent adjacent the vent layer; and the top layer, radiant barrier layer, vent layer, THSL and intumescent form a unitary structure that comprises a rigid sheet, a rigid panel or a flexible roll, at least two of the layers are combined together, and the THSL has a heat capacity greater than 100 kJ/kg, and a heat absorbing range of 10° C. to 50° C.; and a plurality of outer roof barriers mounted to the roof deck such that the roof products are positioned between the roof deck and the outer roof barriers.

6. A roof according to claim 5, wherein the channels of the vent layers form contiguous, uninterrupted air flow paths between abutting roof products having inlets only adjacent an eave of the roof and outlets only adjacent a ridge of the roof, and the top layer has scores, such that the building product is configured to be rolled up, and configured to be flexible and accommodate irregularities in a roof deck surface;

the structural supports comprise a phase change material (PCM);

the roof products are configured to be flexible at a temperature of about 0° C., and are structurally sound to provide a walkable roof surface at a temperature in excess of 70° C.;

a flame retardant is combined with the THSL, wherein the flame retardant and the THSL each comprise media, and the media are mixed and combined in a single layer; and the THSL has a heat capacity greater than 200 kJ/kg, and a heat absorbing range of 20° C. to 40° C.

7. A roof according to claim 6, wherein the roof products have lower moisture barriers, such that the roof products comprise an only component located between the roof deck and the roof barriers;

the PCM comprises at least one of calcium chloride hexahydrate, sodium sulfate, $Na_2SO_4.10H_2O$, $CaCl_2.6H_2O$, $Na_2S_2O_3.5H_2O$, $Na_2CO_3.10H_2O$, $NaHPO_4.12H_2O$, strontium chloride hexahydrate, potassium chloride or calcium chloride;

the air flow channels in the vent layer have openings, and each opening has an effective area of 0.01 $in^2$ to 1 $in^2$; and the THSL has an average particle size of less than 0.5 mm.

* * * * *